US006565087B1

(12) United States Patent
Taylor et al.

(10) Patent No.: US 6,565,087 B1
(45) Date of Patent: May 20, 2003

(54) GIFT OPENING GAME

(76) Inventors: Earle R. Taylor, 5575 Andrews St., Roscoe, IL (US) 61073; Wanda S. Taylor, 5575 Andrews St., Roscoe, IL (US) 61073

( * ) Notice: Subject to any disclaimer, the term of this patent is extended or adjusted under 35 U.S.C. 154(b) by 0 days.

(21) Appl. No.: 09/917,460

(22) Filed: Jul. 28, 2001

(51) Int. Cl.[7] ..... A63F 9/00

(52) U.S. Cl. ..... 273/142 R; 273/138.1; 273/139; 273/236; 273/440; 273/446

(58) Field of Search ..... 273/142 R, 138.1, 273/268, 270, 236, 273, 139, 271

(56) References Cited

U.S. PATENT DOCUMENTS 3,602,515 A * 8/1971 Seidman ..... 206/315.1
3,747,934 A * 7/1973 Barrett ..... 273/268
4,364,561 A * 12/1982 Gill ..... 123/196 A
4,444,393 A * 4/1984 Brankovic ..... 273/108.52
5,112,048 A * 5/1992 Kienle ..... 273/118 R
5,139,270 A * 8/1992 Gernhofer ..... 273/269
5,295,695 A * 3/1994 Tamanini ..... 273/459
5,957,457 A * 9/1999 Shaw ..... 273/269
6,171,166 B1 * 1/2001 Oquita ..... 383/119

* cited by examiner

*Primary Examiner*—Benjamin H. Layno
*Assistant Examiner*—Dolores R. Collins
(74) *Attorney, Agent, or Firm*—Boyle Fredrickson Newholm Stein & Gratz S.C.

(57) ABSTRACT

An apparatus and method for playing a game at a party for enhancing the enjoyment of a plurality participants during the party, while gifts are being opened. The game apparatus and method includes, providing a plurality of gift items, providing a concealing device for individually covering each of the gift items from view, providing a participant with a unit for advancing play during the game. The participant is further provided with a member for making the concealing device more difficult to remove during play. The goal is to remove the concealing device to reveal a gift item before the removing is stopped. If a gift is fully revealed during play, the participant may retain the gift item.

28 Claims, 4 Drawing Sheets

GIFT OPENING GAME

BACKGROUND OF THE INVENTION

1. Field of the Invention

The present invention relates in general to the field of games. More particularly, the present invention relates to party games played for amusement at a celebration where gifts are distributed. Specifically, a preferred embodiment of the present invention relates to a game that involves several people competing in the unwrapping of a package that contains several gifts.

2. Discussion of the Related Art

Historically, the tradition of giving gifts at parties or holidays has generally been a rather routine and at times mundane affair. Further, people with large families may find it difficult, time consuming, and expensive to buy and carry individual gifts for all of their family members. Traditional gift exchanges involve passing a gift to the recipient and, on occasions where appropriate, a return exchange. At children's parties or other events where a gift package is given out to those attending the party, such packages are merely distributed in decorated bags or packages at a predetermined time. However, because this is always an enjoyable experience, very few have sought to increase the enjoyment and excitement.

An equally respected tradition at parties and holiday celebrations is the playing of games to create unity and enjoyment among the gathering. Various games have been devised to facilitate the enjoyment of those gathered at a celebration.

The below-referenced U.S. patents disclose embodiments that were at least in-part satisfactory for the purposes for which they were intended. The disclosures of all the below-referenced prior United States patents in their entireties are hereby expressly incorporated by referenced into the present application for purposes including, but not limited to, indicating the background of the present invention and illustrating the state of the art. U.S. Pat. No. 5,957,457 to Shaw discloses a Bingo type game to enhance the enjoyment of partygoers while the guest of honor opens his gifts. U.S. Pat. No. 6,171,166 discloses an interlocking chamber piñata. However, neither of these disclosed games combines the enjoyment of a party goer gift exchange with that of a party game. Therefore, what is needed is a game that combines the enjoyment of a party goer gift exchange with the thrill and excitement of a party game.

SUMMARY AND OBJECTS OF THE INVENTION

A primary object of the invention is to provide an apparatus that is a game that incorporates the celebration traditions of gift exchanges and game playing. Another object of the invention is to provide a game that increases the excitement of the celebratory gift exchange thereby increasing the excitement, enjoyment, and overall unity of the celebration. Still another object of the invention is to provide an apparatus that has one or more of the characteristics discussed above but which is relatively simple to assemble and transport. Yet another object of the invention is to provide a method that can be used to relatively inexpensively and conveniently enhance the enjoyment of a plurality of participants during a party. It as another object of the instant invention to combine the traditions of holiday gift giving with the tradition of the party game in a single package.

These, and other, aspects and objects of the present invention will be better appreciated and understood when considered in conjunction with the following description and the accompanying drawings. However, many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompany and forming a part of this specification, wherein like reference numerals designate the same elements in the several views, and in which.

Figure 1:
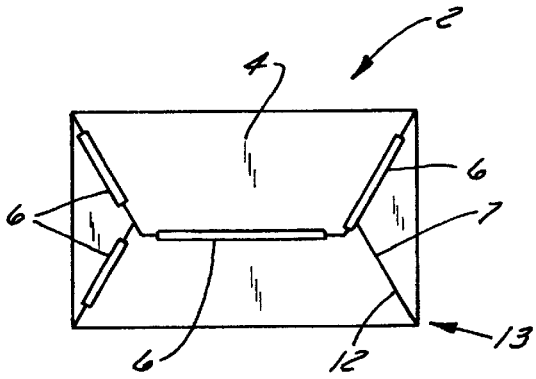
FIG. 1 illustrates a side perspective view of a gift component package consisting of a series of interwrapped gift items according to one embodiment of the instant invention.

In describing the preferred embodiment of the invention, which is illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

Pursuant to a preferred embodiment of the invention, a game and method of enhancing the enjoyment of participants during a celebration, based on the opening of gifts is provided. The inventive game includes a unit for advancing the game play, a game components package, a concealing device, and a means for making opening more difficult. The method of playing the game includes removing the concealing device with the goal to reveal a gift and retain it if fully revealed before the removing is stopped by the unit for advancing game play. The means for making opening more difficult is recommended to be a one size fits all glove and/or tape. The game components package is envisioned as a plurality of individually wrapped gift items interwrapped from an original, higher valued, center gift. The gift items may be wrapped in several layers of decorative paper with each layer having at least one loose opening of decorative paper for opening the package with the glove. The loose openings are not aligned with either of its surrounding layer's loose openings. The game components packages may be arranged for a boy's birthday, girl's birthday, teen's birthday, general holiday (e.g. Christmas), audience, baby shower, bridal shower or adult's birthday. The unit for advancing the game play may be a pair of game die, a spinning device marked at least once with a portion bearing the word "STOP," or similar play advancing means.

2. Detailed Description of Preferred Embodiments

The invention is constructed in accordance with what is shown in FIGS. 1–8 and may be employed in any similar form. The construction of the basic components of the game such as the game die and the gift items is well-known to those skilled in the art and therefore a detailed description thereof is not necessary to fully understand the present invention which is directed to novel improvements in the field of party games.

Referring to FIG. 1, a game or a gift component package 2 comprised of a series of interwrapped gift items 10 (FIGS. 5–6) according to one embodiment of the instant invention is shown. The gift component package 2 is concealed using some device such as a box, decorative bag or wrapping paper 4. The wrapping paper 4 is wrapped in such a manner that the seams 12 are sealed with a means for making the wrapping paper more difficult to remove 6 such as adhesive tape, glue or any other means for sealing. Preferably, one corner 13 of the wrapped gift component package 2 has a seam 12 lacking the tape 6 such that it creates a loose opening 7 for removing the wrapping paper 4 from the first layer of the gift component package 2.

Figure 3:
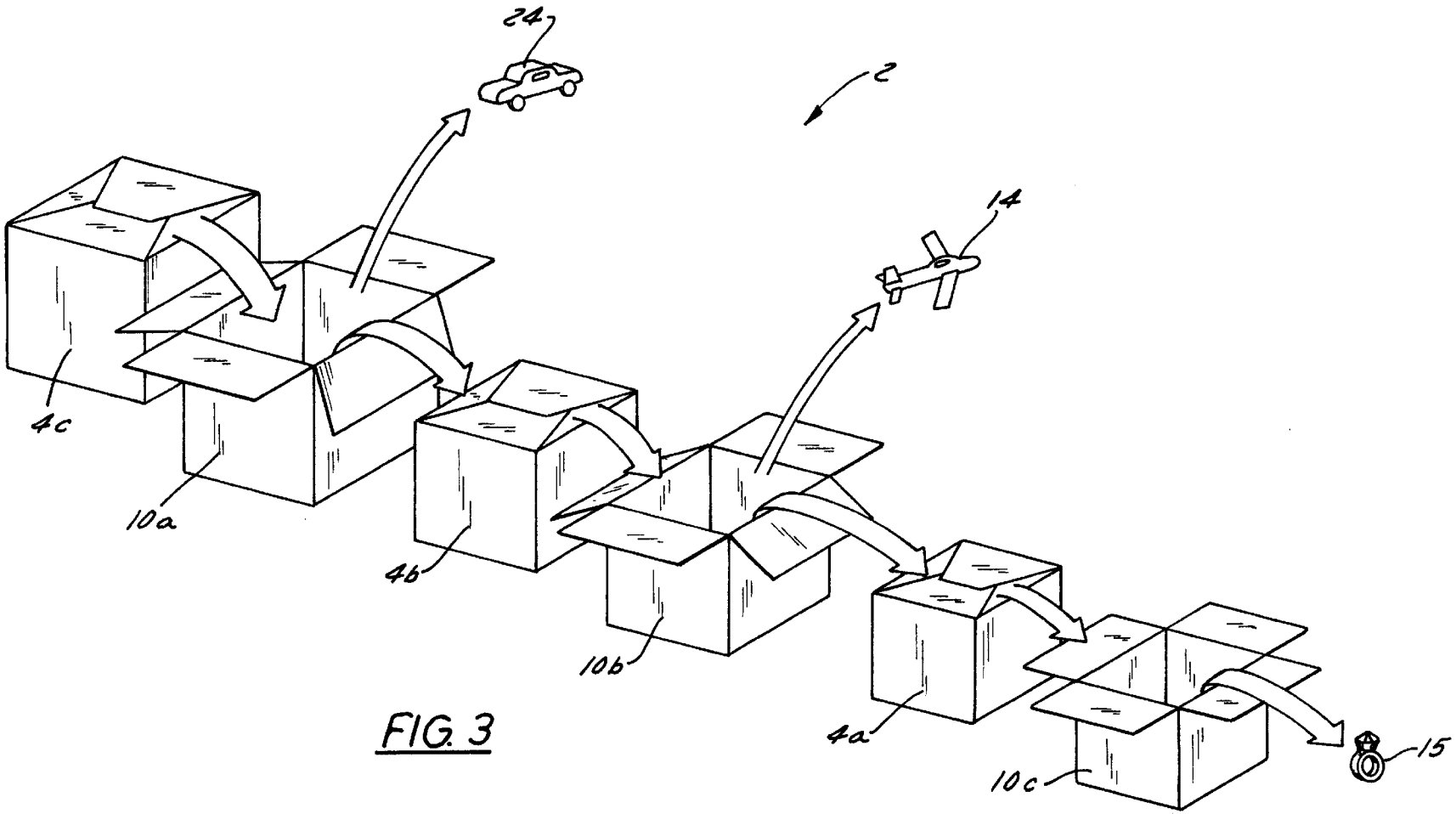
FIG. 3 illustrates a side perspective view of the successive wrapped gift items and the successive revealed gift items of the gift component package.

As best seen in FIG. 3, the gift component package 2 may be assembled by using a first piece of wrapping paper 4*a* to conceal a box 10*c* containing a first gift item 15 in the manner previously described. Then a second piece of wrapping paper 4*b* is used to conceal a box 10*b* containing a second gift item 14 and the first wrapped gift item. Next, a third piece of wrapping paper 4*c* is used to conceal a box 10*a* third gift item 24 and the wrapped first and second gift items. Such a method continues until every gift has been wrapped into the gift component package. There may be as many as five or more layers of wrapping paper per gift item. Also, the package 2 may contain a plurality of gift items such as fifteen or more.

Figure 2:
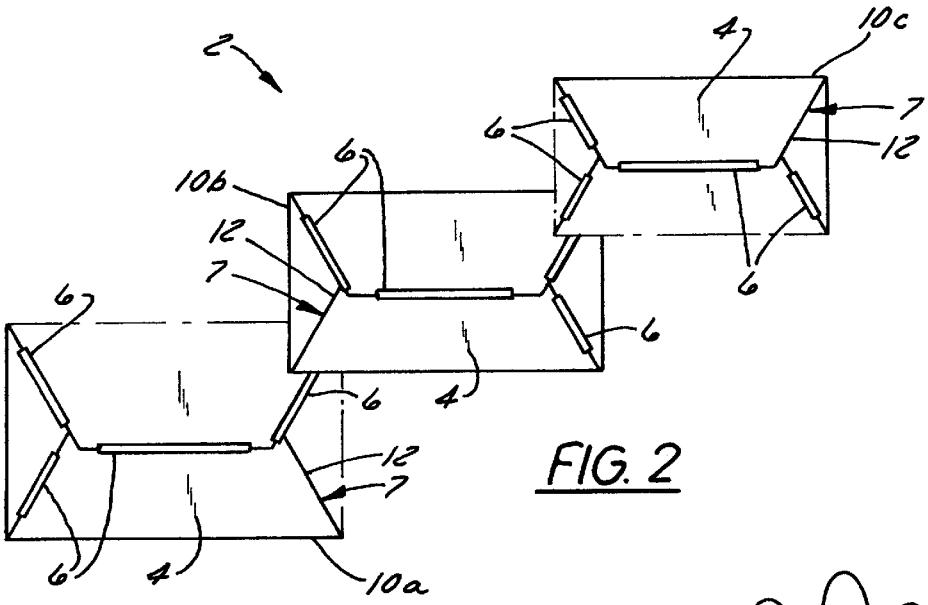
FIG. 2 illustrates a schematic phantom view of the inside of the game component package showing the alternating loose openings.

Referring now back to FIG. 2, a phantom view of the inside of the gift component package 2 is shown illustrating the alternating loose openings 7. It should be noted that the gift component package is represented in FIG. 2 for improved clarity. Within each layer of the gift component package 2 is an individually wrapped gift item 10. The loose opening 7 as described in FIG. 1 of each individual gift item 10 preferably has a different position than either of its surrounding layers. This is achieved by placing the tape 6 on different seams 12 in each layer such that the loose opening 7 occurs in an alternative corner 13 than its surrounding layers. This limits the number of loose openings 7 to prevent the opening of more than single layer of wrapping paper 4.

Referring now to FIG. 3, the successive wrapped gift packages 10*a,b,c* (e.g. a square box) and the successive revealed gift items 14, 15, 24 (e.g. a toy car, socks, an airplane, ornament, collectible, a baseball, cologne, a ring, a tie, a household item, a promotional item (See FIG. 7), etc.) of the gift component package 2 are shown. Upon the opening of each layer of the gift component package 2, a revealed gift item 14, and another wrapped gift package 10*b,c* is encountered until only the first, high value, wrapped gift item 15 is exposed. Although a box is shown as retaining the gift item, a box is not necessary. Nevertheless, additional wadded paper or cardboard may be used in the wrapping process to break up the outline of the gift item and thus add to the game's excitement.

Figure 4:
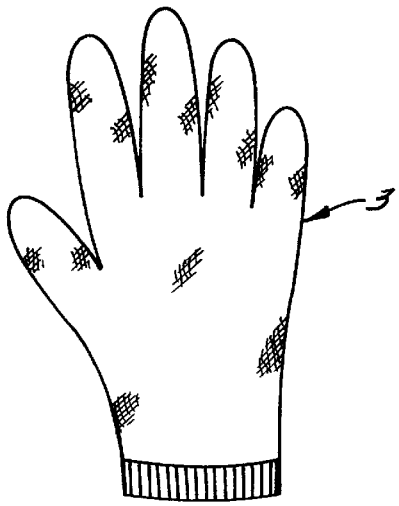
FIG. 4 illustrates a top view of a one-size fits all oversized glove according to one embodiment of the instant invention.

Referring now to FIG. 4 an additional means for making the wrapping paper 4 heavy-duty, more difficult to remove is shown. Specifically a pair of one-size fits all, oversized work gloves 3 is shown.

Figure 5:
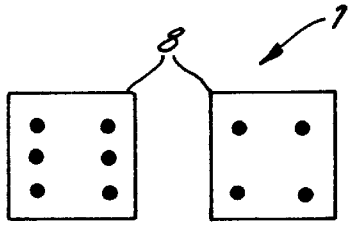
FIG. 5 illustrates a top view showing a pair of game die for advancing game play.
Figure 6:
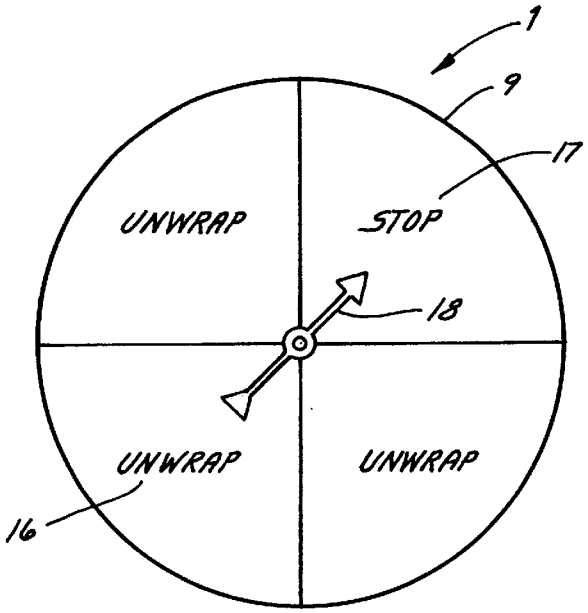
FIG. 6 illustrates a top view showing a spinning device for advancing game play.
Figure 8:
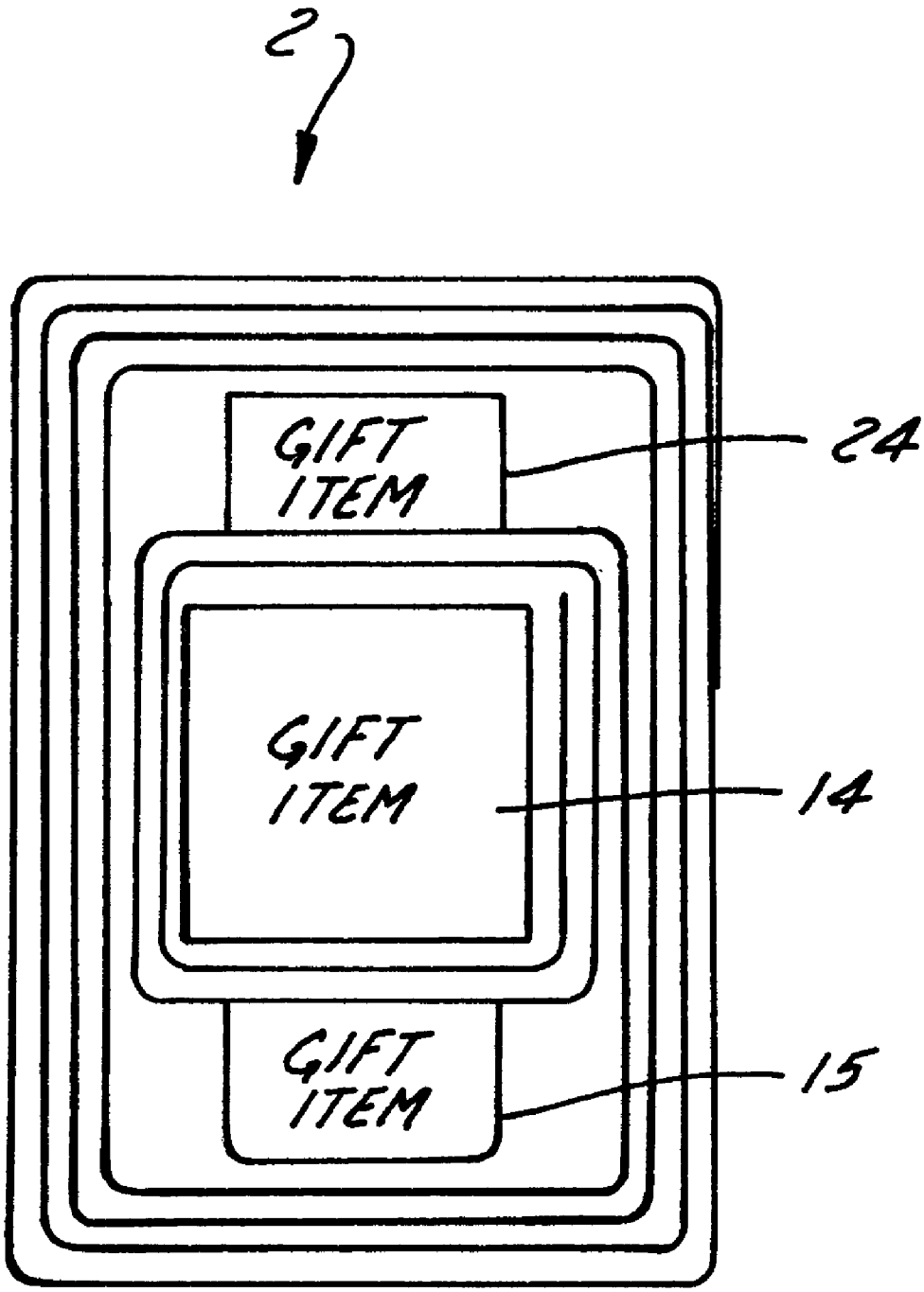
FIG. 8 is a schematic illustrating a components package of the present invention wrapped in multiple layers of wrapping paper.

Referring now to FIG. 8, preferably each gift item 14, 15, 24 of the components package 2 of the present invention is wrapped in multiple layers of wrapping paper. This makes it more difficult to get to the gift item. Also in the preferred embodiment, each individually wrapped gift item is interwrapped to the adjacent gift item with multiple layers. These multiple layers of wrapping add to the excitement of the game and the mystery surrounding the type of gift enclosed under the layers 3. In Use and Operation The object of the inventive game is to remove the a wrapping paper 4 while wearing the pair of gloves 3 from the layer of the gift component package 2 exposing a revealed gift 14 and another wrapped gift item 10 before your turn is ended by the unit for advancing game play 1 (FIGS. 5–6). This is accomplished by placing a portion of the hand wearing the glove 3 in a loose opening 7 of the wrapped gift item 10 and removing the wrapping paper 4.

Referring now specifically to FIG. 5, one alternative unit for advancing game play 1 is shown as a pair of game die 8. The person sitting clockwise from the participant attempting to unwrap a layer of the gift component package 2 rolls the game die 8 until that person rolls doubles or any other predetermined combination. At that time, the participant with the gift component package 2 must stop unwrapping the gift component package 2. The participant then removes the oversized, one-size fits all gloves 4 and passes both the gift component package 2 and the gloves 3 to the participant with the die 8. The participant with the die 8 passes the die to the next participant sitting clockwise from them upon reception of the gift component package 2 and gloves 3. Any revealed gifts 14 that are fully exposed before the participant sitting clockwise the participant unwrapping the gift component package 2 rolls doubles, become the possession of the participant unwrapping the gift component package 2. This process is repeated until the first gift item 15 is revealed.

Referring now to FIG. 6, a second alternative unit for advancing game play 1 is shown. A spinning device 9 is one possible unit 1 for advancing game play. The spinning device 9 includes at least one stop section 17, at least one unwrap section 16 and an arrow 18 which can be spun around a stationary axis. The person sitting clockwise from the participant attempting to unwrap a layer of the gift component package 2 spins the spinning device 9 until the arrow 18 lands on the stop section 17. At that time the participant with the gift component package 2 must stop unwrapping the gift component package 2, remove the oversized one-size fits all gloves 4 and pass both the gift component package 2 and gloves 3 to the participant with the spinning device 9. The participant with the spinning device 9 passes the spinning device 9 to the next participant sitting clockwise from them upon reception of the gift component package 2 and gloves 3. Any revealed gifts 14, 24 that are fully exposed before the participant sitting clockwise from the person unwrapping the gift component package 2 spins the arrow 18 and it lands on a stop section 17 become the possession of the person unwrapping the gift component package 2. This process is repeated until the first gift item 15 is revealed.

Figure 7:
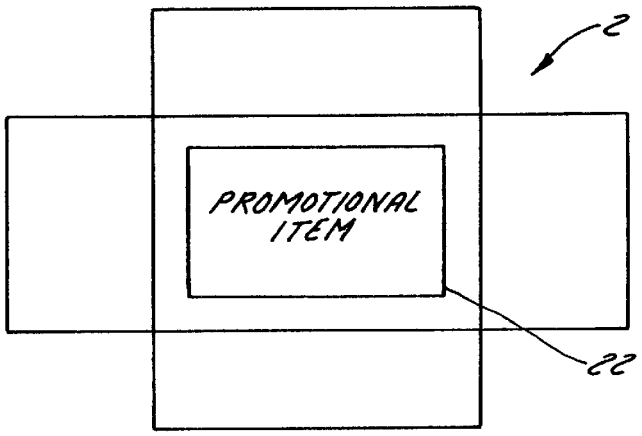
FIG. 7 illustrates a top view showing a promotional gift item.

FIG. 7 shows a formerly concealed gift item that is a promotion item 22 for a sports team, manufacturer, etc. The game 2 could be used to promote such products or services. Moreover, the use of such gift items may be used to keep down the retail cost of the game.

Although the best mode contemplated by the inventor of carrying out the present invention is disclosed above, practice of the present invention is not limited thereto. It will be manifest that various additions, modifications and rearrangements of the features of the present invention may be made without deviating from the spirit and scope of the underlying inventive concept.

Any number of means for concealing the gift items, members for making the concealing device more difficult to remove, and units for advancing game play could be used. In addition, the individual components need not be fabricated from the disclosed materials, but could be fabricated from virtually any suitable materials. For example, any type of paper product, similar thin and tearable material or other means to conceal could be used to conceal the gift items and thus wrapping paper need not be the only material used. The unit for advancing play may also include a hourglass or other timing device. The means could include a blindfold instead of gloves. Also, there is an infinite amount of possible gilt items that could be included depending on the age, the celebration, and interest of the party goers. For instance, such items could include boy birthday party items, girl birthday party items, baby shower items, Christmas gift items, adult party items, etc.

Moreover, the individual components need not be formed in the disclosed shapes, or assembled in the disclosed configuration, but could be provided in virtually any shape, and assembled in virtually any configuration. While the drawing illustrate wrapped gifts that are squared off it is conceivable that a variety of wrapped shapes could be used provided that the contain a single loose opening. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended subclaims.

What is claimed is:

1. A method of gift item distribution at a party for enhancing the enjoyment of a plurality of participants during said party; said distribution comprising the following steps:

a) providing a participant with a gift components package containing several individually wrapped gift items and a pair of gloves;

b) requiring the participant to wear the gloves;

c) having the participant attempt to unwrap the package before play is advanced to the next participant; and d) advancing the package to another participant.

2. The method of claim 1, wherein said gift component package comprises a plurality of gift items.

3. The method of claim 2 wherein said gifts items are wrapped in a decorative paper.

4. The method of claim 3 wherein said gift items include a first gift item.

5. The method of claim 4, wherein said gift items are interwrapped to each other with said decorative paper, originating at said first gift item.

6. The method of claim 5, wherein said decorative paper is attached to said gift item by tape.

7. The method of claim 6, wherein said gift items are wrapped in several layers of said decorative paper.

8. The method of claim 7, wherein said gift items have only one loose opening of decorative paper for opening the package with said gloves.

9. The method of claim 1 wherein said gifts items are wrapped in a decorative paper.

10. The method of claim 9, wherein said decorative paper is attached to said gift item by tape.

11. The method of claim 1 wherein said gift items include a first gift item.

12. The method of claim 1, wherein said gift items are interwrapped to each other with decorative paper, originating at a first gift item.

13. The method of claim 1, wherein said gift items are wrapped in several layers of decorative paper.

14. The method of claim 1, wherein said gift items have only one loose opening of decorative paper for opening the package with said gloves.

15. The method of claim 1, wherein the step of advancing the package includes rolling at least one die.

16. The method of claim 1, wherein said gifts items are wrapped in a plurality of bags.

17. The method of claim 16, wherein said bags are attached to said gift items by adhesive tape.

18. The method of claim 16, wherein said bags are attached to each other by adhesive tape.

19. The method of claim 1, wherein the step of providing a participant with a gift components package further comprises:

concealing a first gift item with a first wrapper sealed at all corners but one;

concealing a second gift item with a second wrapper configured to enclose the first item and the second, the second wrapper sealed at all corners but one;

concealing a third gift item with a third wrapper configured to enclose the first item, the second item, and the third item, the third wrapper sealed at all corners but one.

20. The method of claim 19, wherein the first gift item is more valuable than the second gift item and the second gift item is more valuable than the third gift item.

21. A method for playing a game at a party for enhancing the enjoyment of a plurality participants during said party, said game comprising the following steps:

providing a plurality of gift items;

providing a concealing device for individually covering each of said gift items from view;

providing said participants with a unit for advancing play during the game;

providing said participants with a member for making the concealing device more difficult to remove during play, wherein the member for making the concealing device more difficult to remove is at least one work glove;

removing said concealing device with a goal to reveal gift item until the removing is stopped and play is advanced; and allowing the participant to retain the gift item if it is fully revealed.

22. The method of claim 21, wherein the unit for advancing is a pair of game dice.

23. The method of claim 21, wherein the concealing device is wrapping paper.

24. The method of claim 21, wherein the concealing device is a bag.

25. The method of claim 21, wherein the member for making the concealing device more difficult to remove is adhesive tape.

26. The method of claim 21, wherein the member for making the concealing device more difficult to remove is adhesive tape which seals all seams of the gift except one.

27. The method of claim 21, wherein the providing a concealing device includes:

an initial step of concealing a first higher valued gift item with a first piece of wrapping paper having all corners but one enclosed by an adhesive tape; next concealing a second gift item with a second piece of wrapping paper configured to enclose the first item and the second, the second piece of paper having all corners but one enclosed by an adhesive tape; then concealing a third gift item with a third piece of wrapping paper configured to enclose the first item, the second, and the third item, the third piece of paper having all corners but one enclosed by an adhesive tape.

28. The method of claim 21, wherein the gift item is a promotional item from a manufacturer for marketing purposes.

* * * * *